United States Patent [19]

Ishigaki et al.

[11] 4,186,552

[45] Feb. 5, 1980

[54] WRISTWATCH CASE

[75] Inventors: Hisao Ishigaki, Tokyo; Ryuzo Tanaka, Tanashi; Koichi Nakajima, Tokyo, all of Japan

[73] Assignee: Citizen Watch Co., Ltd., Japan

[21] Appl. No.: 855,802

[22] Filed: Nov. 29, 1977

[30] Foreign Application Priority Data

Nov. 30, 1976 [JP] Japan ..... 51-143026

[51] Int. Cl.[2] ..... G04B 37/06; G04B 39/00

[52] U.S. Cl. ..... 58/88 W; 58/91

[58] Field of Search ..... 58/88 R, 90 R, 91, 88 W, 58/90 B

[56] References Cited

U.S. PATENT DOCUMENTS

| | | | |
|---|---|---|---|
| 3,006,139 | 10/1961 | Hug et al. | 58/90 R |
| 3,492,810 | 2/1970 | Levrat | 58/88 R |
| 3,789,605 | 2/1974 | Kishida | 58/88 R |

*Primary Examiner*—S. J. Witkowski

[57] ABSTRACT

A case for a wristwatch, which comprises a shell fabricated from an outer thin metal plate, an annular metallic reinforcing member positioned within said shell, and an inner shell composed of an injection molded synthetic resin, said inner shell lying in intimate contact with an inner surface of said shell and having an inwardly facing annular recess into which said annular reinforcing member is fitted.

9 Claims, 6 Drawing Figures

WRISTWATCH CASE

BACKGROUND OF THE INVENTION

This invention relates to a case for a wristwatch.

Wristwatches are generally composed of a movement for measuring and displaying time and a case for protecting the movement as is widely known. There is now a trend towards a conversion from mechanical to electronic movements for the sake of obtaining higher accuracy, and watch cases, in addition to protecting the movement, must be designed and constructed from the viewpoint of ornamentation as well as function where modern wristwatches are concerned. Research and development in this field is proceeding.

Wristwatch cases are frequently subjected to harsh conditions and severe use. It is therefore necessary to fabricate these cases from materials which exhibit weather and scratch resistance while at the same time maintaining an attractive appearance, such materials being limited to brass, stainless steel, synthetic resins, hard alloys, and the like. Each of these materials possess both advantages and disadvantages; brass, for example, is easily machined but exhibits poor corrosion resistance if its surface is not plated; hard alloys are attractive and remarkably weather resistant but are difficult to machine; and synthetic resins, although they are readily machined and weather resistant, are much less attractive than the other materials mentioned. Stainless steel is comparatively easy to machine, exhibits excellent weather resistance and possesses a characteristic appearance of high-quality, accounting for its widespread use as a material for constructing modern watch cases. However, when fabricating a watchcase even stainless steel requires a high level of machining technique and numerous processing steps in comparison to brass or synthetic resin, a fact which inevitably leads to high production costs. Stainless steel is therefore unsuitable for fabricating inexpensive wristwatch cases.

In view of these circumstances, a number of proposals have been made which contemplate the production of a watch case by subjecting a thin metal plate such as stainless steel or brass to a press operation in order to form a shell the inside of which is provided with a synthetic resin that is unified with the shell. Such a case maintains the external appearance of the stainless steel but is much easier to machine. Nevertheless, these cases involved a large number of defects.

First, there is the case where the shell fabricated from the thin metal sheet and the synthetic resin portion to be provided inside the shell are formed individually and then integrated. The synthetic resin portion when formed undergoes contraction and is thus integrated with the already formed shell by bending one end of the shell. Even so, there is still a gap between both members which invites the penetration of water, perspiration and other contaminants which can foul the wristwatch during use. To overcome this problem it is necessary to grind the synthetic resin portion so as to obtain the prescribed dimensions. This has little merit in so far as lowering costs is concerned and has not been put to practical use.

Second, there is a case where a casting synthetic resin is poured inside the shell so as to form the watch case. In this instance an extended period of time is required for the liquid resin to harden after it has been poured. It is also difficult to maintain constant polymerization conditions so that it becomes impossible to uniformly maintain the cast resin composition. Moreover, waterproofing ability becomes a problem since air bubbles remain in the resin after hardening.

Third, a synthetic resin for injection molding can be poured inside the shell to form the watch case. In general, the watch case possesses a ring-shaped configuration and a varying, complex cross-section which includes a continuous portion for a band and holes for external control members. As a result, the synthetic resin portion begins to exhibit a directional property at the time of injection molding regardless of the injection conditions, and the deformation which accompanies this phenomenon appears at the inner and outer diameter of the synthetic resin portion. Accordingly, defects arise which are identical to those that occured in the first example.

Although a watch case obtained by equipping the inside of a shell fabricated from a thin metal plate with a synthetic resin member appeared to be promising in theory, the watch cases of this type actually possessed numerous problems as outlined above and were not highly appraised in terms of low cost and appearance.

As the result of intensive research and experimentation with regard to watch cases in which a synthetic resin portion is disposed inside a shell, it has been discovered that the fatal flaws of the prior art, namely the gap between the shell and the resin portion as well as the deformation of the resin portion along its inner diameter, can be eliminated if an annular reinforcing member is disposed inside the shell along with an injection molding resin provided in such a manner as will allow it to retain the reinforcing member. It has also been discovered that an extremely inexpensive watch case can be obtained by combining watch case constituent elements such as packing or a threaded portion with the annular reinforcing member or the synthetic resin member.

SUMMARY OF THE INVENTION

It is, therefore, an object of the present invention to provide an improved case for a wristwatch which can overcome the shortcomings encountered in the prior art.

It is another object of the present invention to provide a wristwatch case which is simple in construction, easy to manufacture and low in manufacturing costs.

It is another object of the present invention to provide a wristwatch case which provides a highly improved water-proofing ability and exhibits an appearance of high-quality.

BRIEF DESCRIPTION OF THE DRAWINGS

These and other objects, features and advantages of the present invention will become more apparent from the following description when taken in conjunction with the accompanying drawings, in which.

DESCRIPTION OF THE PREFERRED EMBODIMENTS

Figure 1:
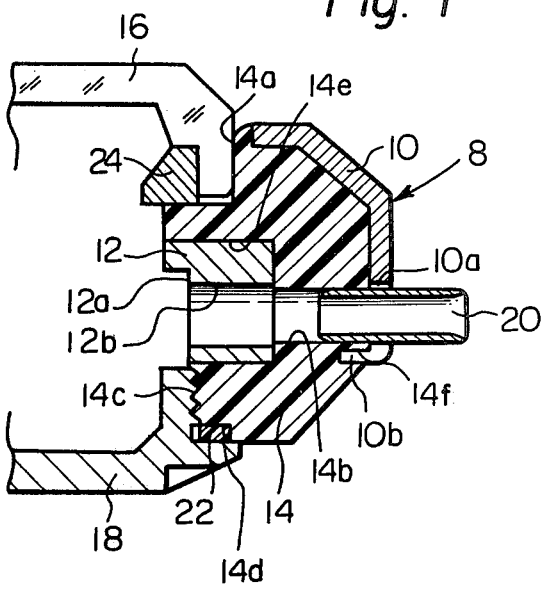
FIG. 1 is a cross-sectional view of a preferred embodiment of a case for a wristwatch according to the invention.

FIG. 1 is a cross-sectional view of a case for a wristwatch according to the invention. The wristwatch case comprises a case body 8 composed of an outer shell 10, an inner shell 14 and an annular reinforcing member, 12, a watchglass, a back cover 18, and a pipe.

The outer shell 10 is fabricated by subjecting a thin stainless or other metal steel sheet to a pressing operation and constitutes the principal outer portion of the case body 8 as viewed from the outside. The side of outer shell 10 is provided with a radial hole 10*a* to allow penetration of the pipe 20, the lower edge 10*b* of the outer shell being inwardly bent and engaging an outwardly facing annular recess 14*f* of the inner shell. The outer surface of shell 10 is provided with a surface finish by way of grinding and polishing machining. Annular reinforcing member 12 is made of metal such as stainless steel, formed such that its inner annular portion 12*a* defines a portion of the inner wall of the case body 8, and is provided at one portion with a radial hole 12*b* for insertion of a winding stem (not shown). Inner shell 14 is made of an injection molded resin and is formed by injecting the resin between the outer shell 10 and the annular reinforcing member 12 to form a one-piece structure with outer shell 10 and reinforcing member 12. The upper portion of inner shell 14 is provided with a watchglass press-fitting recessed portion 14*a* which allows the watchglass 16 to be press-fitted and secured, the central portion is equipped with a hole 14*b* to allow press-fitting of the winding stem accommodating pipe 20, and the lower portion is provided with a threaded portion 14*c* to allow the back cover 18 to be screwed in place, and with a stepped portion 14*d* for compressing a packing 22. Watchglass 16 is formed of a synthetic resin and is press-fitted and secured to the press-fitting portion 14*a* of the inner shell 14 by means of a tension ring 24 inserted within the edge of its inner circumferential portion. The inner shell 14 is formed at its inner side wall with an inwardly facing annular recess 14*e* into which the annular reinforcing member 12 is fitted. A water-proof condition is maintained between watchglass 16 and the press-fitting portion 14*a* due to the elastic deformation of the inner shell 14. Back cover 18 is screwed into the threaded portion 14*c* of molded member 14.

According to this construction, the contraction which accompanies hardening of the synthetic resin that forms the inner shell 14 is hindered and greatly reduced by the shell 10 and annular reinforcing member 12. Accordingly, the circumferential wall dimension of the press-fitting portion 14*a* is accurately provided even though the watchglass 16 is press-fitted into said portion 14*a*, whereby a sufficient water-proof condition can be maintained without requiring finishing by means of a grinding operation. Furthermore, the threaded portion 14*c* of the inner shell 14 allows the back cover 18 to be tightly screwed in place without requiring a thread cutting operation and allows suitable compression of the packing 22. Rain water and perspiration do not penetrate the timepiece movement since there is no gap between the shell 10 and inner shell 14. Moreover, the inner portion 12*a* of the annular reinforcing member 12 serves as the inner wall of the case so that it is possible to enhance the accuracy at which the inner wall of the case engages the movement or a center frame of the watch.

Although the hole 10*a* is formed in the shell 10 prior to molding the inner shell 14, and the hole 14*b* is formed in inner shell 14 at the time that it is molded, the hole 12*b* can be formed in the reinforcing member 12 before or after the inner shell 14 is molded. Further, pipe 20 is secured in hole 14*b* of the molded member in order to assure a water-proof condition; however, the pipe can also be secured to the inner shell 14 at the time that the same is injection molded.

Figure 2:
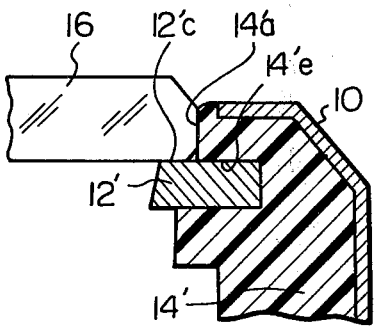
FIGS. 2 through 4 are partial cross-sectional views of modified forms showing the secured portion of a watchglass.
Figure 3:
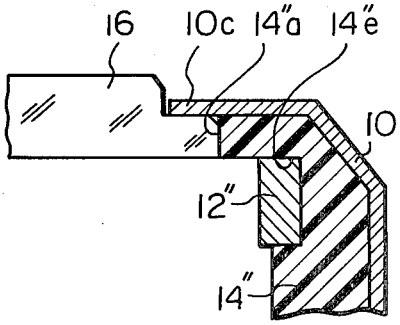
Figure 4:
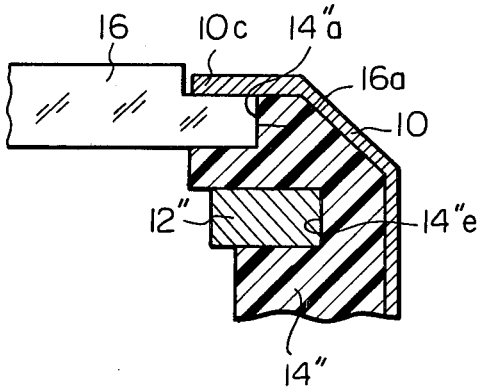

FIGS. 2 through 4 illustrate modified forms of the invention. FIG. 2 shows an example in which the upper portion of inner shell 14' is provided with the annular reinforcing member 12' is such a manner that the upper surface 12*c* of the reinforcing member serves to seat the watchglass 16. In this case the reinforcing member 12' also serves as a ring which is fitted in the annular recess 14'*e* of the inner shell 14'. The watchglass 16 is fitted into the press-fitting portion 14'*a* of the inner shell 14, whereby said fitting portion deforms elastically so as to maintain a water-proof condition.

According to this construction, the annular reinforcing member 12' and shell 10 greatly suppress the contraction of the watchglass press-fitting portion which, as produced by the conventional method, could not maintain the prescribed dimensions due to contraction related errors. Restriction of contraction allows precise dimensions to be obtained. This fact allows the watchglass 16, the outer shape of which is irregular, to be secured to the inner shell 14 in a state which maintains a water-proof condition.

FIG. 3 shows an example in which the edge portion 10*c* of shell 10 extends over the upper portion of inner shell 14'', with the lower portion of watchglass 16 being press-fitted and secured to the press-fitting portion 14''*a* of the inner shell. The press-fitting portion 14''*a* is thus formed at a high accuracy while a water-tight condition is maintained between watchglass 16 and said fitting portion. A reinforcing member 12'' is fitted in an annular recess 14''*e*, an upper radial wall of which is aligned with the bottom wall of glass 16.

FIG. 4 is an example in which the outer circumferential portion 16*a* of the watch glass 16 is unified, along with the shell 10 and annular reinforcing member 12'', with the inner shell 14'' by means of injection molding. This prevents contraction of the molded member along the periphery of the circumferential portion 16*a*, and makes it possible to obtain a watch case which is unified with the watchglass 16.

Figure 5:
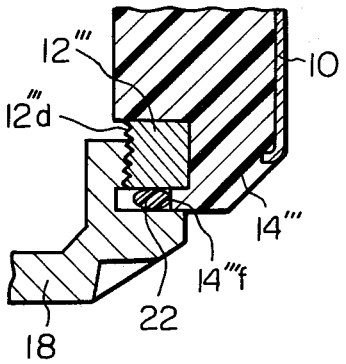
FIGS. 5 and 6 are partial cross-sectional views of other modified forms showing the secured portion of a back cover.
Figure 6:
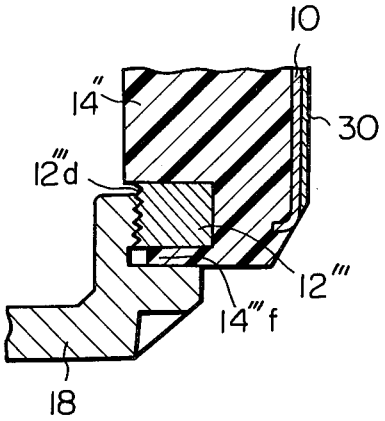

FIGS. 5 and 6 also illustrate other modifications of the invention. In FIG. 5, annular reinforcing member 12''' having threads 12'''*d* over its inner surface is provided at the lower portion of inner shell 14''', a residual annular radial extension or portion 14'''*f* protruding in a radial direction at a position below the reinforcing member. The residual portion 14'''*f* is thick enough to allow suitable compression of the packing 22 when the back cover 18 is attached. This construction allows the annular reinforcing member 12''' and shell 10 to prevent contraction of the inner shell 14''' as well as provide engagement for the back cover 18 while maintaining a water-proof condition.

In FIG. 6, the residual portion 14'''*f* of the inner shell 14''' is inwardly extended and compressed between the back cover 18 and annular reinforcing member 12''', making it possible to eliminate the packing 22 used in the embodiment of FIG. 5. The shell 10 is fabricated from brass and its outer surface is provided with a corrosion resistant gold plating 30.

Although the present invention has been described with reference to a number of embodiments, it is to be understood that other embodiments are possible without departing from the scope of the invention. It also goes without saying that any combination of the described embodiments is within the scope of the invention.

As metals which can be used to fabricate the shell 10 there may be mentioned, in addition to stainless steel and brass, such metals as copper, nickel silver, aluminum, gold, and silver. If brass, copper, nickel silver or aluminum are adopted, it is necessary to provide the outer surface of the shell with a hard film in order to enhance corrosion resistance and appearance. It is also possible to enhance the appearance of stainless steel, gold or silver by surfacing these metals with a hard film. These hard films can be formed by electro-plating, gas-phase plating, an alumite treatment, or the like.

As materials which can be used to fabricate the annular reinforcing member, in addition to metals such as stainless steel, brass, nickel silver, aluminum, there may be mentioned synthetic resins which possess excellent rigidity and dimensional stability. Fiber reinforced plastic (FRP) is particularly favorable.

As the injection molding resin for the inner shell there may be used dimensionally stable, heat resistant synthetic resins such as phenolic resin, polycarbonate, and polyester glass reinforced synthetic resin, etc. The materials used to fabricate the shell, annular reinforcing member and inner shell may be freely selected as the situation demands.

As described above, the case for a wristwatch in accordance with the invention comprises a shell fabricated from a thin metal plate, an annular reinforcing member positioned within the shell, and an inner shell consisting of an injection molded synthetic resin, said inner shell being in intimate contact with the inner surface of the outer shell and retaining the annular reinforcing member. This allows the case to present the same, attractive external appearance as the conventional metal watch case and prevents contraction of the molded member during its injection molding so that it can remain in intimate contact with the shell. It is also possible to improve the engagement between the movement of the timepiece and the watchglass, back cover, pipe and other components which constitute the case. In particular, it is possible to secure an irregularly shaped watch glass to the molded member in a waterproof manner without the need of a water-proof packing.

What is claimed is:

1. A wristwatch case comprising:

a watchglass;

a case body for retaining said watchglass and including an outer shell made of a metallic sheet plate, an inner shell having an outer peripheral wall a major portion of which is held in intimate contact with an inner wall of said outer shell and having an inwardly facing annular recess, and an annular metallic reinforcing member disposed in the inwardly facing annular recess of said inner shell, said inner shell being formed by injection molding a synthetic resin to form a one piece structure with said outer shell and said annular reinforcing member, and said inner shell having a recessed portion to which said watchglass is fitted; and a back cover secured to the inner shell of said case body.

2. A wristwatch case according to claim 1, further comprising a tension ring inserted within an inner circumferential portion of said watchglass.

3. A wristwatch case according to claim 1, in which said annular recess is formed at an upper portion of said inner shell at a position adjacent a lower portion of said recessed portion, and in which said reinforcing member radially and inwardly extends to serve as a seat for said watchglass.

4. A wristwatch case according to claim 2, in which said outer shell has an edge portion extending over the upper portion of said inner shell, with a lower portion of said watchglass being press fitted and secured to the recessed portion of said inner shell.

5. A wristwatch case according to claim 4, in which an outer circumferential portion of said watchglass is unified, along with said outer shell and annular reinforcing member, with said inner shell by means of injection molding.

6. A wristwatch case according to claim 1, in which said annular recess is formed at a lower portion of said inner shell, and in which said annular reinforcing member has a threaded portion onto which said back cover is threaded.

7. A wristwatch case according to claim 6, in which said inner shell has an inwardly extending residual flange portion which is compressed between said back cover and said annular reinforcing member.

8. A wristwatch case according to claim 1, in which said outer shell is provided at its outer surface with a corrosion resistant film.

9. a wristwatch case comprising:

a watchglass;

a case body for retaining said watchglass and including an outer shell made of a metallic sheet plate by pressing and having a first radial hole, an inner shell having a second radial hole concentric with said first radial hole, said inner shell having an outer peripheral wall a major portion of which is held in intimate contact with an inner wall of said outer shell and having an inwardly facing annular recess, and an annular metallic reinforcing member disposed in the inwardly facing annular recess of said inner shell and having a third radial hole concentric with said first and second holes, said inner shell being formed by injection molding a synthetic resin to form a one piece structure with said outer shell and said annular reinforcing member, and said inner shell having a recessed portion to which said watchglass is fitted;

a winding stem accommodating pipe extending through the first radial hold of said outer shell and press fitted to the second radial hole of said inner shell; and a back cover secured to the inner case of said case body.

* * * * *